US006715535B2

(12) United States Patent
Kahn et al.

(10) Patent No.: US 6,715,535 B2
(45) Date of Patent: Apr. 6, 2004

(54) METHOD OF AND DEVICE FOR ROTARY CASTING

(75) Inventors: Friedhelm Kahn, Ehringshausen (DE); Joachim Kahn, Ehringshausen (DE); Gerhard Eisenberger, Dillenburg (DE); Horst Paul Grüness, Bad Oldesloe (DE); Walter Hauder, Linz (AT); Johann Winkler, Amstetten (AT); Peter Stika, Linz (AT); Johann Preisinger, Linz (AT); Peter Jungbauer, Steyregg (AT); Klaus Schröter, Linz (AT); Rolf Gosch, Wels (AT)

(73) Assignee: VAW mandl & berger GmbH, Linz (AT)

( * ) Notice: Subject to any disclaimer, the term of this patent is extended or adjusted under 35 U.S.C. 154(b) by 0 days.

(21) Appl. No.: 09/835,890

(22) Filed: Apr. 16, 2001

(65) Prior Publication Data

US 2002/0000304 A1 Jan. 3, 2002

(30) Foreign Application Priority Data

Apr. 19, 2000 (DE) ..... 100 19 309

(51) Int. Cl.[7] ..... B22D 23/00; B22D 35/04

(52) U.S. Cl. ..... 164/136; 164/335; 164/323; 164/324

(58) Field of Search ..... 164/136, 335, 164/336, 322, 323, 324, 129, 130

(56) References Cited

U.S. PATENT DOCUMENTS

| | | | | | |
|---|---|---|---|---|---|
| 4,155,400 | A | * | 5/1979 | Rosin et al. | 164/136 |
| 4,733,714 | A | * | 3/1988 | Smith | 164/130 |
| 5,163,500 | A | * | 11/1992 | Seaton et al. | 164/130 |
| 5,626,180 | A | * | 5/1997 | Kahn et al. | 164/136 |
| 5,704,413 | A | * | 1/1998 | Takasaki et al. | 164/136 |
| 5,819,837 | A | * | 10/1998 | Hugo et al. | 164/61 |
| 6,386,265 | B1 | * | 5/2002 | Usui | 164/114 |

FOREIGN PATENT DOCUMENTS

| | | | |
|---|---|---|---|
| DE | 2429529 A1 | 1/1975 | |
| DE | 4244789 A1 | 12/1994 | |
| DE | 19607805 C1 | 7/1997 | |
| DE | 19734286 C1 | 4/1998 | |
| EP | 0 656 819 B1 | 3/1999 | |
| EP | 0942789 A1 | 9/1999 | |
| GB | 2 187 984 | 9/1987 | |
| JP | 62028060 | 2/1987 | |
| JP | 7-132364 | 5/1995 | B22D/23/00 |
| JP | 2000-176629 | 6/2000 | B22D/23/00 |
| WO | WO 94/29050 A2 | 12/1994 | B22D/23/00 |

* cited by examiner

*Primary Examiner*—M. Alexandra Elve
*Assistant Examiner*—Kevin P. Kerns
(74) *Attorney, Agent, or Firm*—Harness, Dickey & Pierce, P.L.C.

(57) ABSTRACT

A method of casting has a mold assembled on a base plate. The finished mold is rotated by approximately 180° around a horizontal rotational axis. A casting container with an upwardly positioned aperture end, removed from the mold, is filled with melt for one casting operation. The casting container is sealingly coupled by the aperture end to the ingate end of the mold. The mold, together with its contacting casting container, is rotated by approximately 180° around a horizontal axis. Accordingly, the melt reaches the mold, and the casting container is removed from the coupled position away from the mold.

24 Claims, 6 Drawing Sheets

METHOD OF AND DEVICE FOR ROTARY CASTING

CROSS-REFERENCE TO RELATED APPLICATIONS

This application is based upon and claims priority to German Patent Application 100 19 309.9 filed Apr. 19, 2000, which application is herein expressly incorporated by reference.

FIELD AND BACKGROUND OF THE INVENTION

The present invention relates to a method and device for rotary casting. Methods and devices are known from EP 0656819 and U.S. Pat. No. 5,626,180, where a mold with a downwardly opening ingate is moved together with a casting container with an upwardly opening aperture. Melt for one casting operation is filled into the casting container. The mold, together with the casting container, is rotated approximately 180° around a horizontal axis so that the melt reaches the mold. In this case, the casting container is filled, via a filling aperture, which is provided with a special closure.

SUMMARY OF THE INVENTION

It is an object of the present invention to provide a method and device which improves productivity when using the method for mass production purposes. In a method of rotary casting, a mold with an upwardly pointing ingate end is mounted on a base plate. The finished mold is rotated with the base plate approximately 180° around a horizontal rotational axis. Thus, the ingate end points downwardly. A casting container with an upwardly positioned aperture end is filled with melt for one casting operation. The casting container, by means of its aperture end, is sealingly coupled to the downwardly pointing ingate end of the mold. The mold, with the contacting casting container, is rotated by approximately 180° around a horizontal axis so that the melt reaches the mold. The casting container is released from the coupled position and removed from the mold.

A device for rotary casting has a mold mounted on a base plate. An ingate points away from the upper face of the base plate. A bearing mechanism supports the base plate so that the base plate is rotatable around a horizontal rotational axis by at least 180°. A casting container has an aperture which may be positioned to point towards the upper face of the base plate. Also, moving means is coupled with the casting container to move the casting container with its aperture into a sealing arrangement with the downwardly pointing ingate of the mold. The casting container is rotatable together with the mold around a horizontal rotational axis by at least 180°. In the rotated position, the casting container may be removed from the upwardly pointing ingate of the mold.

In accordance with the inventive method and the inventive device, the mold, either manually or partly in an automated way, can be assembled easily and quickly. Assembling the mold is simplified and easily controllable. Furthermore, because the casting container is filled away from the mold, improved control exists when filling the casting container which does not require a special closure mechanism. Advantages of rotary casting are achieved by rotating the mold after it has been assembled and by coupling the casting container from below, e.g. by coupling the aperture of the casting container to the ingate of the mold. Accordingly, the casting operation is calm and turbulence-free when subsequently rotating back or further rotating the mold with the coupled casting container around a horizontal axis. In order to accelerate the process further and to prepare for the next casting operation, the casting container can be removed upwardly from the mold whose ingate now points upwards. Further, it becomes possible to place a pressure hood onto the upwardly opening ingate to improve the solidification process by applying gas pressure. Optionally, feeders positioned at the top end and coupled with the mold may be provided. The gas pressure is preferably applied after a complete, hardened surface layer has formed in the mold.

In principle, the mold may include molded material parts with a base plate of molded material. The mold may include a so-called core package where all the surfaces of the mold cavity are formed of cores. The mold can also be erected on a base plate made of metal. Optionally, the mold may contain side walls made of metal which receive inserted inner cores of molded material. The mold is upwardly sealed by a cover core made of molded material. This means the mold can form a so-called semi-die. Finally, the mold can be provided entirely in the form of a permanent mold. Here, the mold has a metallic base plate, metallic side walls and a metallic cover into which the required molded material cores are inserted. This means the mold can be provided in the form of a die.

In a preferred embodiment, the finish-assembled mold without the coupled-on casting container is rotated around the same horizontal axis as the mold with the coupled-on casting container. It is advantageous that the mold on its own and the mold together with the coupled-on casting container, in each case, be rotated around an axis which passes through the mold and is positioned near the base plate. This ensures that the entire assembly is supported approximately in the center of gravity. Preferably the rotational axis of rotation extends in the direction of the greatest extension of the inner cavity of the mold.

The method is preferably carried out in such a way that, for the purpose of coupling and removing the casting container to and from the mold, the casting container carries out a radial movement relative to the horizontal rotational axis. In order to transfer the casting container into a filling position, the casting container carries a pivoting movement around the axis of the radial movement. Accordingly, the necessary separation of the casting container from the mold can be achieved by simple movement sequences. Thus, the operations of assembling the mold and filling the casting container can overlap in terms of time.

The inventive device comprises a bogie with two cheek parts. Swivel pins are supported in the cheek parts. Furthermore, in a preferred embodiment, the casting container is displaceable on a column which is arranged radially relative to the horizontal swivel pins. The column is slid onto one of the swivel pins. In order to place the pivot movement into effect, the column is preferably provided with an attached radial pivot arm. The radial pivot arm is rotatable around the axis of the column. Also, the casting container is secured directly to the radial pivot arm.

Furthermore, it is proposed that, at its ingate end, the mold includes at least one ingate aperture and one gas discharge line. Both the ingate aperture and gas discharge line assume different angular positions relative to the horizontal rotational axis. In addition, the casting container may include an intermediate wall which, in a position where the casting container is coupled to the mold, extends parallel to the horizontal rotational axis. The intermediate wall dips into the melt and ends at a distance from the base of the casting container. The intermediate wall succeeds in holding back and wiping off oxide layers when the melt is fed into the casting container on one side of the intermediate wall and when rotating the casting container around 180° towards the side. The casting container coupled to the mold is able to cover, via its aperture, both the ingate and the ventilation aperture of the mold. These two openings are positioned on different sides of the intermediate wall.

Preferably, the inventive device is used in a foundry plant such that at least two inventive devices are associated with a melting furnace with a dispensing ladle. The inventive devices are each movable to and fro in a linear movement between a casting station at the melting furnace and at least one solidification station. The assembly and removal of the mold preferably takes place in the casting station where all the handling elements are combined. However, it is also possible to provide a separate station to assemble and remove the mold. If the casting system includes two devices, it is referred to as a tandem system. If there are three devices, it is referred to as a tridem system. The tridem system constitutes the acceptable maximum.

According to a further embodiment, a plurality of inventive devices can be included in a foundry plant such that they are associated with a melting furnace with a dispensing ladle and that they are transferred on a circular track from one casting station to at least one solidification station. This is referred to as a carousel casting system. In this case, the casting station can form the mold assembly and mold removal station. However, in the case of the carousel casting system, it is advisable to provide a mold assembly and mold removal station which is separate from the solidification station.

In an embodiment which deviates from the foundry plant mentioned above, a melting furnace with an associated dispensing ladle can be combined with two inventive devices so that the devices are firmly assembled in a linear arrangement and the dispensing ladle can be moved to and fro between the devices and the melting furnace. In this way, it is possible to simplify the transport and handling facilities.

The above-mentioned latter foundry system can be varied. Here, a melting furnace with an associated dispensing ladle can be combined with a plurality of inventive devices. The devices are arranged in a circular formation such that the dispensing ladle can be pivoted to and fro between the melting furnace and the devices. For a larger number of devices, this is more advantageous then a linear arrangement.

From the following detailed description, taken in conjunction with the drawings and subjoined claims, other objects and advantages of the present invention will become apparent to those skilled in the art.

BRIEF DESCRIPTION OF THE DRAWINGS

A preferred embodiment of an inventive device is illustrated in the drawings and will be described below.

DETAILED DESCRIPTION OF THE PREFERRED EMBODIMENTS

Figure 2:
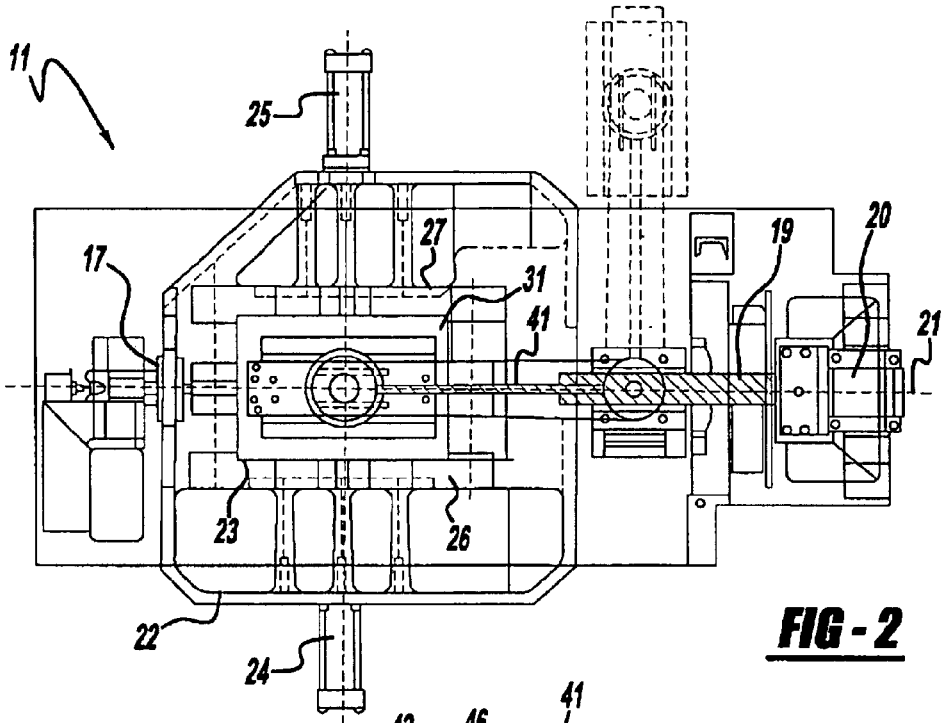
FIG. 2 is a plan view of an inventive device.
Figure 1:
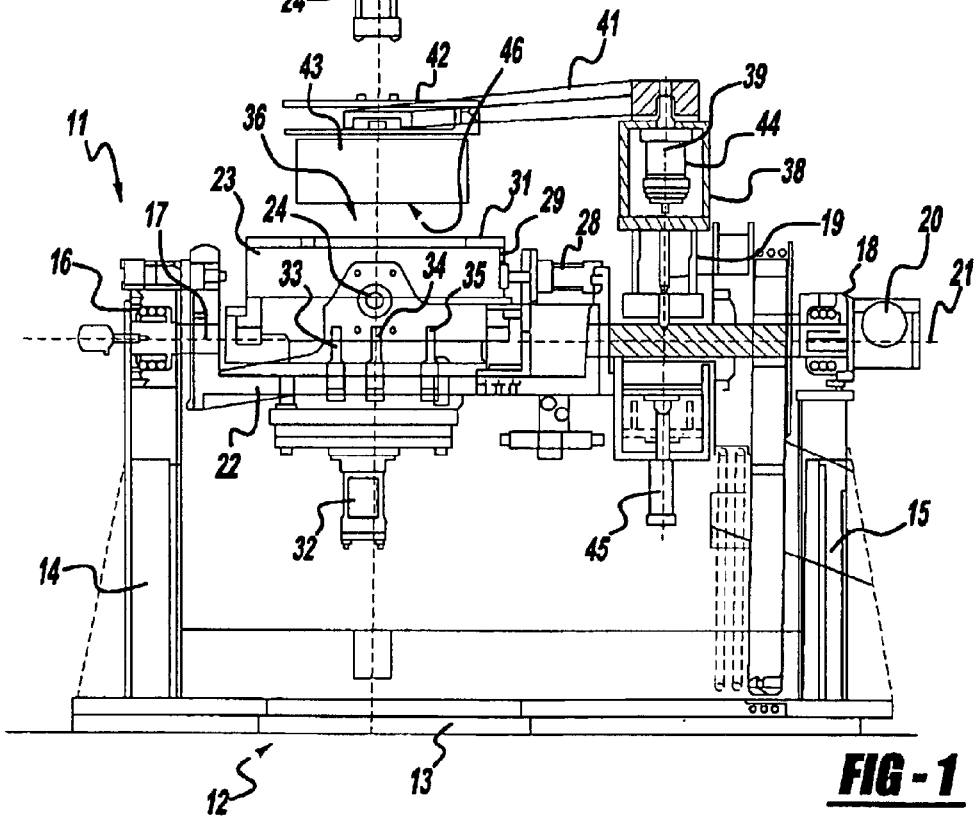
FIG. 1 is a side view of an inventive device.

FIGS. 1 and 2 will be described jointly below. An inventive device 11 includes a bogie 12 which is provided with a base plate 13 and two cheek parts 14, 15. A shorter swivel pin 17 is supported in a bearing 16 in the cheek part 14. A longer swivel pin 19 is supported in a bearing 18 in the cheek part 15. A rotary drive 20 acts on the swivel pin 19. The two swivel pins are positioned co-axially on a horizontal rotational axis 21. A multi-part base plate 22 is inserted between the swivel pins 17, 19. The multi-part base plate 22 is rotatable together with the swivel pins around the rotational axis 21.

A mold 23 is assembled on the base plate 22. The mold's ingate end 36 points upwardly in the position as illustrated. Two setting cylinders 24, 25 act on side parts 26, 27 of the mold 23. The side parts 26, 27 are displaceable relative to the base plate 22. Also, the side parts 26, 27 are securely connected to said base plate 22. Furthermore, the base plate 22 includes a setting cylinder 28 which acts on an end part 29 of the mold 23. The end part 29 is pivotable relative to the base plate 22.

A cover core 31 closes the mold at its upper end. A setting cylinder 32 is provided underneath the base plate 22. Ejectors 33, 34 and 35 pass through the base plate and are actuated by the setting cylinder 32. A column 38 is securely connected to the base plate 22. The column is slid onto the swivel pin 19. The column 38 is telescopic and can be moved along the column axis 39 by a setting cylinder 45. The telescoped out position is shown.

A pivot arm 41 is at the end of the column 38. The pivot arm 41 is aligned substantially radially relative to the column axis 39. The pivot arm 41 includes a base plate 42 which is attached to a casting container 43. The container 43 has an aperture end 46 which points downward. The pivot arm 41 can be rotated around the column axis 39 by a rotary motor 44. The column 38 can be shortened, from the position shown in FIG. 1, towards the horizontal rotational axis 21. The casting container 43 with its lower aperture end 46 is lowered to the upper ingate end 36 of the mold 23. This movement takes place when the casting container is filled. Then, the mold 23 and the casting container 43 are rotated around the horizontal rotational axis 21 by 180° relative to the illustration in FIG. 1.

Prior filling of the casting container preferably takes place in a position where the casting container is rotated around the column axis 39 by 90° out of the position as illustrated in dashed lines in FIG. 2. Also, filling may take place in a position where the casting container is additionally rotated around the horizontal rotational axis by 180°. After the casting container 43 has been filled, the casting container 43 is pivoted by the pivot arm 41 back into a position relative to the mold 23 as illustrated in FIG. 1. However, the entire assembly is rotated by 180° relative to the illustrated position. Thereafter, the column is shortened by the setting cylinder 45. Thus, the upper aperture end 46 of the casting container 43 rests against the downwardly projected ingate end 36 of the mold 23. Thereafter, the entire assembly, in its coupled position, is rotated by 180° while the casting operation takes place. Next, the casting container 43, by moving the column 38 outward, is returned into the illustrated position. To remove the casting container 43, it is pivoted back by approximately 90° into the position illustrated by dashed lines in FIG. 2.

Figure 3:
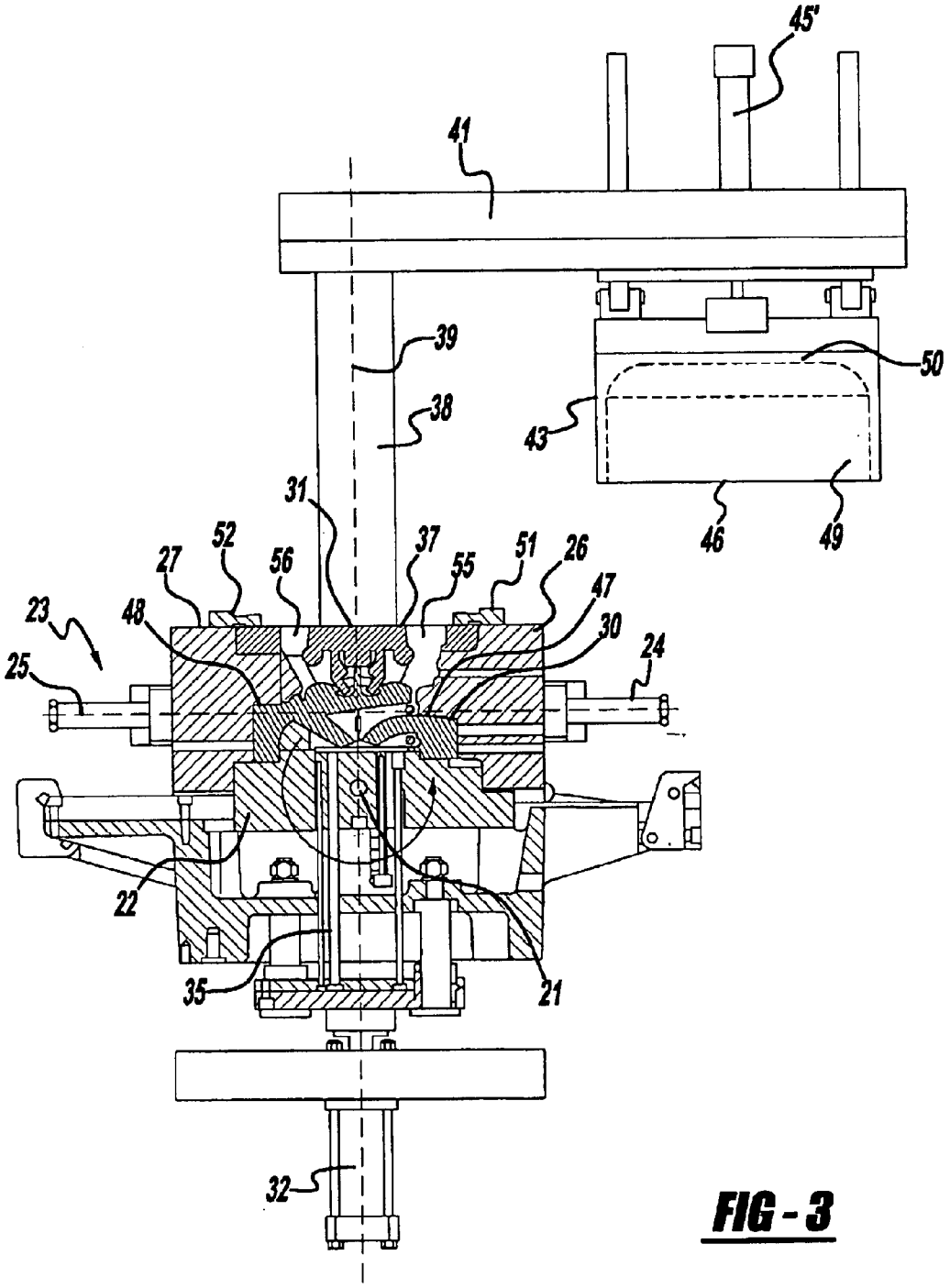
FIG. 3 is a partial cross-section view of an inventive device in a first position.
Figure 4:
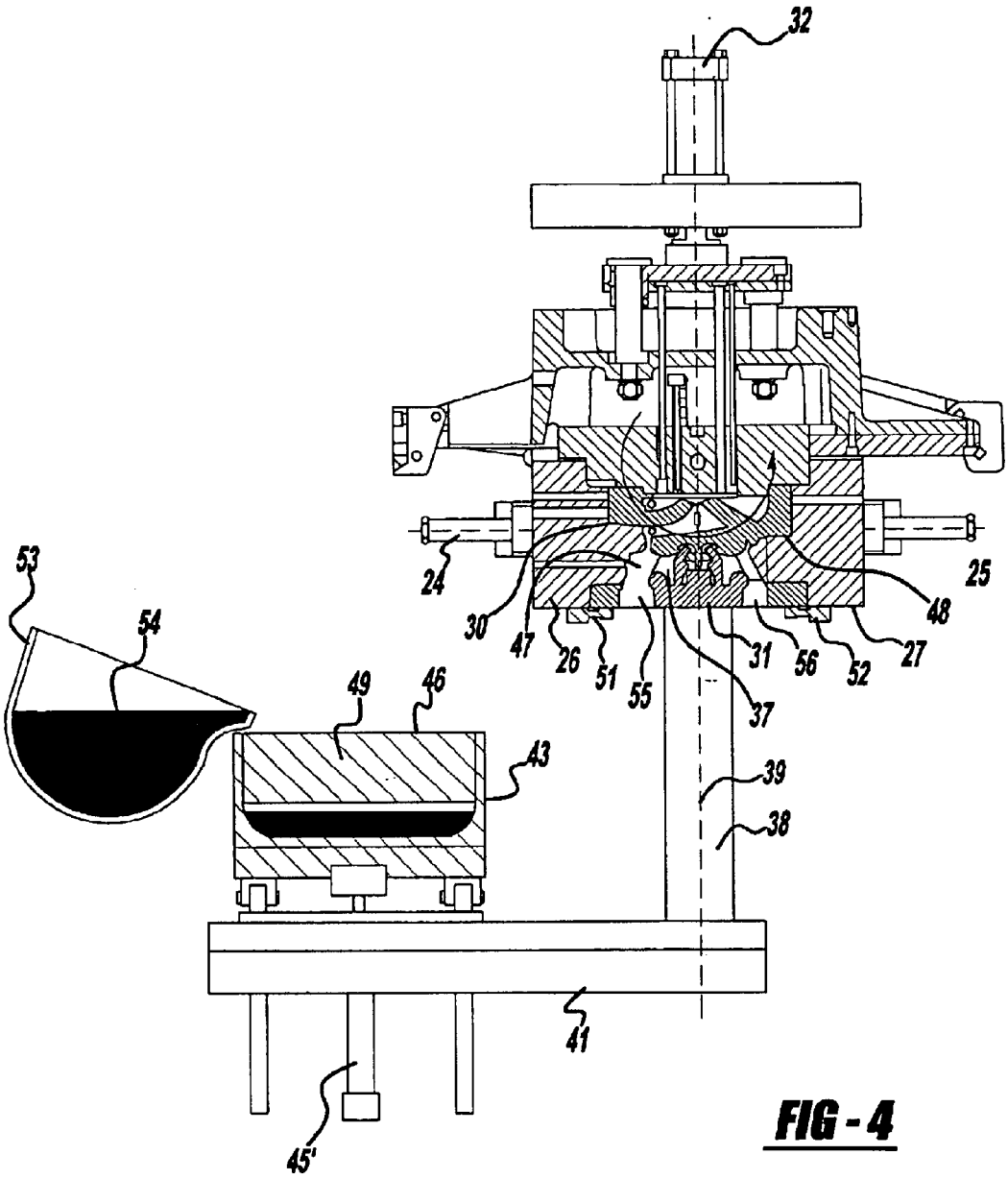
FIG. 4 is a partial cross-section view of an inventive device in a second position.

FIGS. 3 and 4 will be described jointly. The figures illustrate the mold 23 and the casting container 43 in the configuration relative to each other referred to by the dashed lines in FIG. 2. The mold 23 is shown in cross-section and the casting container 43 in a longitudinal section. The column 38, column axis 39 and the pivot arm 41 are only shown schematically. In this embodiment, the column 38 cannot be shortened, but the casting container 43 can be displaced by a setting cylinder 45' relative to the pivot arm 41.

The casting container 43 includes a central longitudinal wall 49 which ends at a distance from the base 50. The mold 23 has a multi-part base plate 22, side parts 26, 27, a plurality of inner cores 30 arranged in several layers, one above the other on the base plate 22, and a cover core 31. The plurality of inner cores 30 are clamped within a continuous power flow between the base plate 22 and the cover core 31. Mold projections 47, 48 extend from side parts 26, 27 to additionally hold some of the inner cores 30 against the base plate 22.

The side parts 26, 27 are displaceable by the setting cylinders 24, 25 relative to the base plate 22. The suspension mechanism of the setting cylinders is not shown here. The side parts 26, 27 can be removed away from one another by means of the setting cylinders 24, 25. Thereafter, the mounting of the inner cores 30 on the base plate 22 can take place. Thereafter, as indicated by oppositely directed arrows, the side parts 26, 27 can be returned to the position as illustrated.

Thereafter, the cover core 31 is laid down and held by locking elements 51, 52. The locking elements 51, 52 mount the cover core relative to the side parts. The locking elements 51, 52 may be pushed back and after the cover core 31 has been laid down, the locking elements 51, 52 move forward into the position as illustrated. Here, the locking elements 51, 52 hold the cover core 31 relative to the inner cores 30 and the side parts 26, 27.

Ejectors 35 are in the base plate 22. The ejectors 35 are actuated by the setting cylinder 32 to remove the mold. The base plate 22 and thus the entire mold 23 is rotatable around the horizontal axis 21. The axis 21 is positioned perpendicularly relative to the drawing plane. This applies in the same way to the column 38 which supports the pivot arm 41 carrying the casting container 43. The casting container 43 can be displaced in parallel with the column axis 39 by the setting cylinder 45' relative to the pivot arm 41.

FIG. 4 shows the finish-assembled mold 23 in its position after completion. The casting container 43 is suspended upside down. The casting container 43 is removed by the setting cylinder 45' from the mold 23. The casting container 43 is pivoted 90° by the pivot arm 41 on the column 38, out of its position for coupling and casting purposes.

In FIG. 4, the mold 23, together with the column 38 and the casting container 43, is rotated by 180° around the horizontal rotational axis 21 relative to the position according to FIG. 3. The casting container 43 is still in the position relative to the mold 23 as shown in FIG. 1. The casting container is now upwardly open and is filled by a dispensing ladle 53 with melt 54 for one casting operation. Thereafter the casting container 43 is pivoted by the pivot arm 41 relative to the column 38, so that the casting container 43 comes to rest under the mold 23 in front of the column 38. The casting container 43 is then lifted by the setting cylinder 45' against the mold 23. Thus, the casting container 43, via its aperture end 46, sealingly rests against the ingate end 36 of the mold 23. In its relative position, the mold 23, together with the coupled casting container 43, continues to be rotated around the horizontal rotational axis 21 by 180°. The melt 54, measured so as to include the correct amount for the mold cavity 37 of the mold 23, flows through an ingate 55 into the mold cavity 37. The gas is able to escape from a gas exit 56 into the casting container 43.

After completion of the rotational operation and thus of the casting operation, e.g. after the position of the mold 23 according to FIG. 1 has again been reached, the casting container 43 is lifted off the mold by the setting cylinder 45' and rotated by the pivot arm 41 back into the position as illustrated in FIG. 3. After completion of the solidification process, the removal of the mold can commence by retracting the side parts 26, 27.

FIGS. 5*a*–5*f* show different phases of the casting operation. The mold 23 includes base plate 22, side parts 26, 27, inner cores 30 and cover plate 31'. Together, they form the mold cavity 37. In this embodiment, the side parts 26, 27 include a molded material whereas the cover plate 31' is a permanent mold part. Claws 57, 58 are adjacent the cover plate 31'. The claws 57, 58 fix the casting container 43 to the mold 23. Two ingate apertures 55, 59 and two gas exits 56, 60 are provided in the cover plate 31'. The casting container 43 is shown, including an outer shell 91, a lining 92 and an intermediate wall 49, as well as the liquid melt 54.

Figures 5A, 5B, 5C, 5D, 5E, 5F:
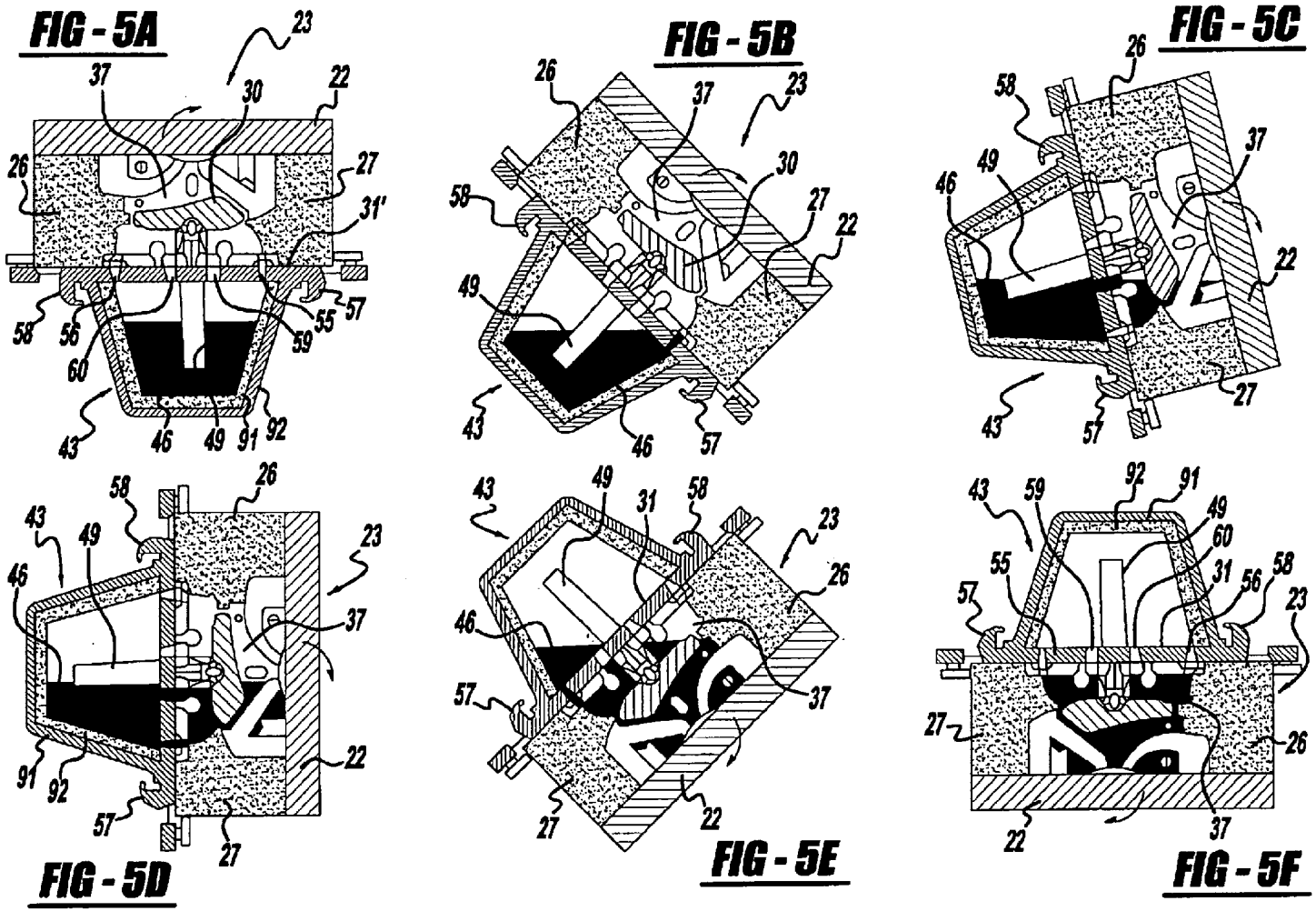
FIGS. 5*a*–5*f* are cross-section view of a mold with a coupled casting container in six different phases.

FIG. 5*a* shows the starting position after the casting container 43 has been coupled to the mold 23. It can be assumed that the melt can be filled into the casting container 43 to the left of the intermediate wall 49. Thus, oxide layers and the like are held back on this side of the intermediate wall 49. An oxide-free melt skin is formed to the right of the intermediate wall 49.

FIG. 5*b* shows the assembly with the mold 23 and the casting container 43 rotated 45° around the rotational axis 21. The melt 54 begins to enter the mold cavity through the ingate aperture 55. The melt impurities are held back by the intermediate wall 49. This position can be reached after two seconds, for example.

FIG. 5*c* shows the assembly with the mold 23 and the casting container 43 rotated 60° around the rotational axis 21. The melt 54 now, additionally, begins to enter the mold cavity through the ingate aperture 59. The melt impurities are still held back by the intermediate wall 49. This position can be reached after four seconds, for example.

FIG. 5*d* shows the assembly with the mold 23 and the casting container 43 rotated 90° around the rotational axis 21. The melt 54 is now located below the intermediate wall 49. The melt impurities float above both ingate apertures 55, 59. This position can be reached after five seconds, for example.

FIG. 5*e* shows the assembly with the mold 23 and the casting container 43 rotated by the rotational axis 21. The melt 54 occupies the mold cavity 37 almost fully. This position can be reached after eight seconds, for example.

FIG. 5*f* shows the end of the casting operation has been reached after the unit, which includes the mold 23 and the casting container 43, has been rotated 180° around the horizontal rotational axis 21. The melt impurities have now reached regions which act as risers and which are removed when the casting is machined. All gases entered the casting container through the gas exits 56, 60. Thus, the ingate was not disturbed at any time.

Figure 6:
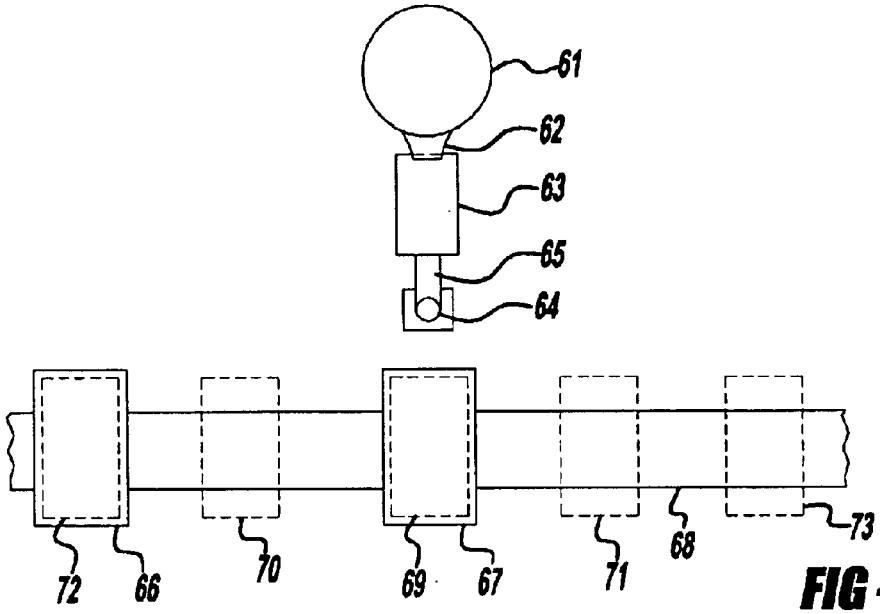
FIG. 6 is an elevation schematic view of a foundry plant in a first embodiment.

FIG. 6 illustrates a schematic of a foundry plant which includes a melting furnace 61, a spout 62 and a dispensing ladle 63 mounted on a column 64, via an arm 65. The arm 65 is rotatable around the axis of the column 64. The arm 65 is movable along the axis of the column 64. The dispensing ladle 63 is rotatable about the axis of the arm 65. Two rotary casting devices 66, 67 are movable on a linear track 68. The devices are movable between a casting station 69, having one of two mold assembling, mold removing stations 70, 71 and one of two hardening stations 72, 73, respectively.

Figure 7:
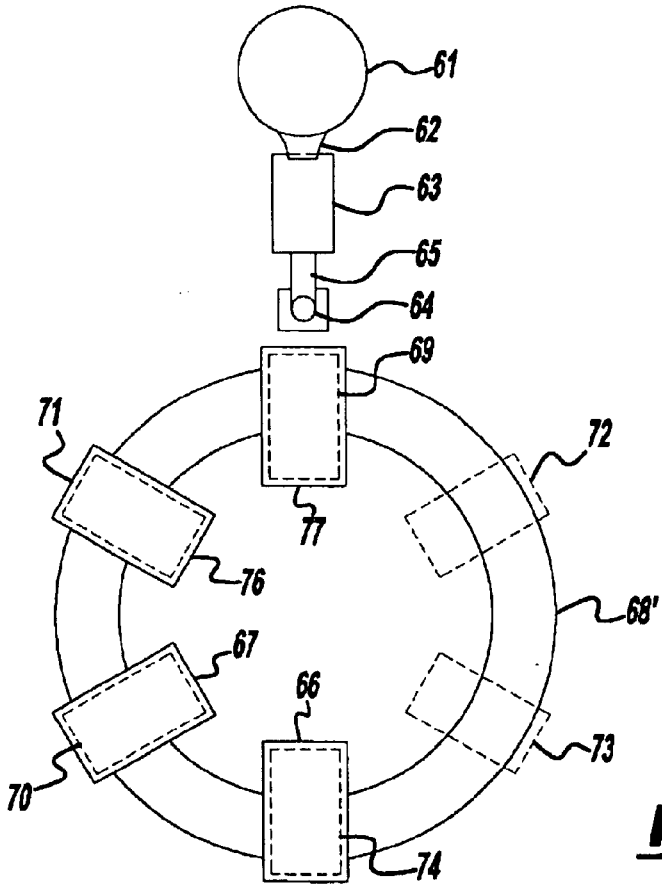
FIG. 7 is an elevation schematic view of a foundry plant in a second embodiment.

FIG. 7 schematically illustrates a foundry plant with a melting furnace 61 and a dispensing ladle 63 corresponding to that of FIG. 6. Corresponding features are given corresponding numerals. Four casting devices 66, 67, 76, 77 are movable on a circular track 68' between a casting station 69, three hardening stations 72, 73, 74 and two mold assembling and mold removing stations 70, 71.

Figure 8:
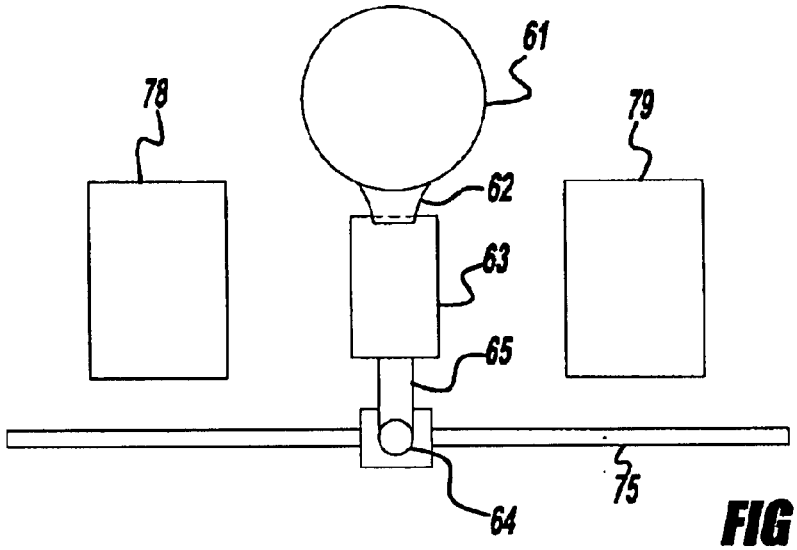
FIG. 8 is an elevation schematic view of a foundry plant in a third embodiment.

FIG. 8 schematically illustrates a foundry plant with a melting furnace 61 and a dispensing ladle 63 having the same details as in FIGS. 6 and 7. Corresponding features are given corresponding numerals. In addition, the column 64 is axially movable along a track 75 between a position in front of the melting furnace and two stationary rotary casting devices 78, 79. The devices combine casting station, molding assembling and mold removing station and hardening station.

Figure 9:
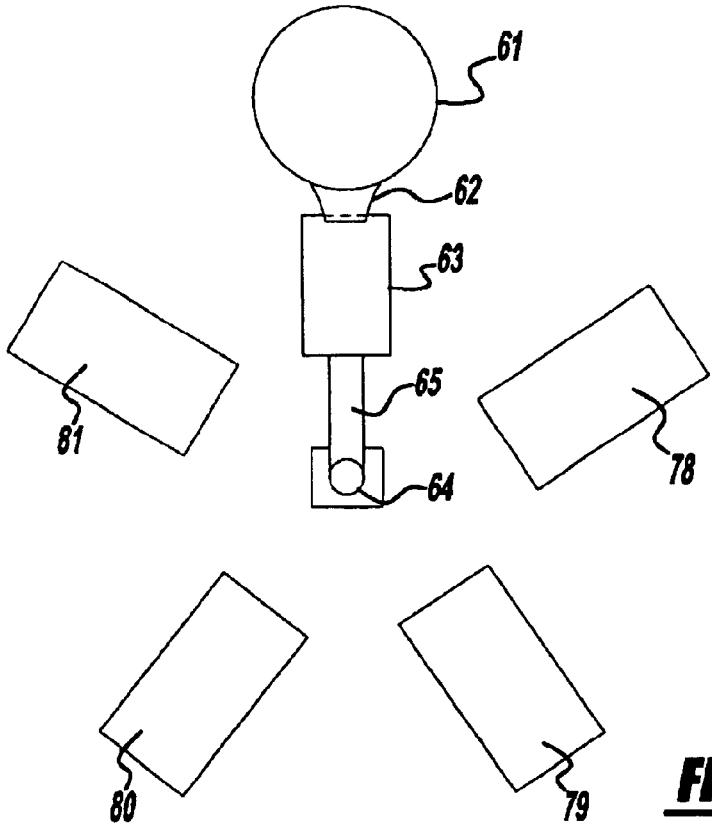
FIG. 9 is an elevation schematic view of a foundry plant in a fourth embodiment.

FIG. 9 schematically illustrates a foundry plant with a melting furnace 61 and a dispensing ladle 63 having the same details as in FIG. 6. Corresponding features are given corresponding numerals. Four rotary casting devices 78, 79, 80, 81 are arranged on a circle around the column 64. Each device 78, 79, 80, 81 may be fed by the dispensing ladle 63, which is rotationable around the column 64. The rotary casting devices each incorporate a casting station, a mold assembling and mold removing station, and a hardening station.

While the above detailed description describes the preferred embodiment of the present invention, the invention is susceptible to modification, variation and alteration without deviating from the scope and fair meaning of the subjoined claims.

What is claimed is:

1. A method of rotary casting, comprising:

providing a mold with an ingate end pointing upwardly and mounting said mold on a base plate;

rotating said mold together with the base plate by approximately 180° around a horizontal rotational axis so that the ingate end points downwardly;

providing a casting container with an upwardly positioned aperture end;

filling said casting container with melt for one casting operation;

then sealingly coupling the casting container with said aperture end to the downwardly pointing ingate end of the mold;

rotating the mold with the casting container approximately 180° around a horizontal axis;

letting the melt move into the mold during said rotating;

releasing the casting container from the mold; and removing the casting container from the mold wherein the casting container aperture end is positioned downward.

2. A method according to claim 1, wherein the mold is comprised entirely of molded material cores.

3. A method according to claim 1, wherein the mold is comprised of permanent mold parts and inner cores of molded material and, at a top end of the mold, a cover core of molded material closing the mold.

4. A method according to claim 1, wherein the mold comprises outer permanent mold parts and inserted mold material cores.

5. A method according to claim 1, further comprising rotating the mold around the horizontal rotational axis which passes through said mold and is positioned at a distance from the casting container.

6. A method according to claim 1, further comprising radially moving the casting container relative to the horizontal rotational axis and pivoting the casting container around an axis of the radial movement for removing the mold.

7. A method according to claim 1, wherein the horizontal axis of rotation extends in the direction of the greatest length of an inner cavity of the mold.

8. A device for rotary casting, comprising:

a mold mounted on a base plate, said mold including an ingate pointing away from an upper face of the base plate;

bearing means for supporting the base plate such that the base plate being rotatable around a horizontal rotational axis by at least 180°;

a casting container having an aperture pointing towards the upper face of the base plate;

means for moving the casting container, said means moving the casting container so that the aperture can be sealingly coupled to the ingate of the mold when the ingate is pointing downwardly, said casting container being rotatable together with the mold around the horizontal rotational axis by at least 180° and said casting containers after being rotated with the mold, being removable from the ingate of the mold when the ingate is pointing upwardly.

9. A device according to claim 8, wherein the mold includes molded material cores.

10. A device according to claim 8, wherein the mold includes a metallic base plate, metallic side parts, molded inner cores, and a molded material cover core.

11. A device according to claim 8, wherein the mold includes permanent mold parts with inserted mold material cores.

12. A device according to claim 8, wherein the device comprises a bogie with two cheek parts, swivel pins supported by said two cheek parts and suspending the base plate.

13. A device according to claim 8, wherein the casting container is displaceable on a column arranged radially relative to the horizontal rotational axis.

14. A device according to claim 13, wherein the column is slid onto one of the swivel pins and is firmly connected to the base plate.

15. A device according to claim 13, wherein a pivot arm is secured to the column, said pivot arm extending radially relative to a column axis, said pivot arm being rotatable around the column axis, and said pivot arm secured to the casting container.

16. A device according to claim 8, wherein the casting container includes an intermediate wall, said intermediate wall positioned in said casting container extending parallel to the horizontal rotational axis when coupled with said mold, said intermediate wall extends from where melt enters the casting container and ends at a distance from a base of the casting container.

17. A device according to claim 8, wherein the mold comprises at least one ingate and at least one gas exit, said at least one ingate and at least one gas exit, when the casting container is coupled to the mold, are positioned on different sides of the intermediate wall.

18. A device according to claim 8, wherein the horizontal axis of rotation extends in the direction of the greatest length of an inner cavity of the mold.

19. A foundry plant, comprising:

a melting furnace having a dispensing ladle and at least two devices according to claim 8, which each can be moved to and fro in a linear movement between a casting station at the melting furnace and at least one hardening station.

20. A foundry plant according to claim 19, wherein a mold assembling and mold removing station separate from the casting station and from the hardening station is provided on a linear track for the at least two devices.

21. A foundry plant, comprising:

a melting furnace with a dispensing ladle and a plurality of devices according to claim 8, said devices are movable on a circular track between a casting station at the melting furnace and at least one hardening station.

22. A foundry plant according to claim 21, wherein a mold assembling and mold removing station separate from the casting station and from the hardening station is provided on the circular track.

23. A foundry plant, comprising:

a melting furnace with a dispensing ladle and at least two devices according to claim 8 which are arranged linearly, and the dispensing ladle is movable to and fro between the devices and the melting furnace.

24. A foundry plant, comprising:

a melting furnace and a dispensing ladle and a plurality of devices according to claim 8, said devices, together with the melting furnace being arranged in a circle and the dispensing ladle being pivoted to and fro between said devices and the melting furnace.

* * * * *